US006361453B1

(12) United States Patent
Nakamura et al.

(10) Patent No.: US 6,361,453 B1
(45) Date of Patent: Mar. 26, 2002

(54) SOLID GOLF BALL

(75) Inventors: Atsushi Nakamura; Hisashi Yamagishi; Takashi Maruko; Yutaka Masutani, all of Chichibu (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 0 days.

(21) Appl. No.: 09/497,641

(22) Filed: Feb. 3, 2000

(30) Foreign Application Priority Data

Jun. 21, 1999 (JP) ..... 11-173635
Jun. 21, 1999 (JP) ..... 11-173636
Jun. 21, 1999 (JP) ..... 11-173637

(51) Int. Cl.[7] ..... A63B 37/04; A63B 37/06
(52) U.S. Cl. ..... 473/371; 473/374; 473/377; 473/376
(58) Field of Search ..... 473/351, 364, 473/367, 368, 370, 371, 372, 373, 374, 376, 377, 359; 525/176, 177, 133, 192, 316

(56) References Cited

U.S. PATENT DOCUMENTS 3,940,145 A * 2/1976 Gentiluomo ..... 473/377
3,965,055 A * 6/1976 Shichman et al. ..... 525/176
4,264,075 A * 4/1981 Miller et al. ..... 473/372
4,611,810 A * 9/1986 Kamata et al. ..... 473/372
5,050,886 A * 9/1991 Yamagishi et al. ..... 473/372
5,407,998 A * 4/1995 Horiuchi et al. ..... 525/133
5,792,009 A * 8/1998 Maruko ..... 473/359
5,967,907 A * 10/1999 Takemura et al. ..... 473/373
5,981,667 A * 11/1999 Asakura et al. ..... 525/316
6,096,830 A * 8/2000 Takemura et al. ..... 525/192
6,149,536 A * 11/2000 Sullivan et al. ..... 473/376
6,174,246 B1 * 1/2001 Hase et al. ..... 473/373
6,186,906 B1 * 2/2001 Sullivan et al. ..... 473/351

OTHER PUBLICATIONS

Efunda Engineering Fundamentals (www.efunda.com).*

* cited by examiner

*Primary Examiner*—Paul T. Sewell
*Assistant Examiner*—Alvin A. Hunter, Jr.
(74) *Attorney, Agent, or Firm*—Sughrue Mion, PLLC

(57) ABSTRACT

In a solid golf ball having a solid core and a cover, the solid core is composed of a core-forming material and particles of a different material. In one embodiment the particles have a higher Shore D hardness than the surface of the core. In a second embodiment, the particles also have substantially the same specific gravity as the core. In a third embodiment, the particles account for 0.1–15% of the core volume and are not exposed on the core surface. These features provide the ball with both a good click and feel, as well as excellent durability and symmetry.

20 Claims, 1 Drawing Sheet

SOLID GOLF BALL

This invention relates to a golf ball having a good "click" and "feel" when hit with a golf club.

BACKGROUND OF THE INVENTION

With its good flight performance and durability, the type of golf ball in most common use today is the solid golf ball composed of a rubber-base core enclosed in a cover.

Solid golf ball of this type, while possessing better flight characteristics than thread-wound golf balls, have in the past had a hard "feel" upon impact. Over the past few years, however, rubber resilience enhancing techniques have been applied to achieve a softer feel without sacrificing flight performance.

While these softer golf balls do have an improved feel, the "click" of the ball when hit with a golf club is dull. Many skilled golfers complain that the click of such balls leaves something to be desired.

Recently, a number of ideas have been proposed for multi-piece golf balls in which the solid core has a multilayer structure comprising an inner layer and an outer layer made of differing materials. Yet, such balls are designed primarily to achieve a softer feel, and do little to resolve the poor click of the ball. Hence, the search has continued for a workable solution to the "dull click" problem associated with softer-type solid golf balls.

Also, golf balls are subject to a number of rules, including strict regulations concerning symmetry. Most commercial multi-piece golf balls are of the multilayer type in which the differing members are arranged concentrically to satisfy the symmetry requirements. As such, improvements in softness have for the most part been achieved through multilayer ball constructions of one sort or another. A constant concern in such constructions is interfacial adhesion between the layers. For instance, where there are large differences in hardness between the layers, interlayer separation and cracking of the constituent members occur.

SUMMARY OF THE INVENTION

Therefore, one object of the invention is to provide a golf ball having both a good click and feel. A second object of the invention is to provide a golf ball which, in addition to having a good click and feel, also has excellent symmetry and durability.

We have found that, rather than trying to resolve the problem of a dull click in softer-type solid golf balls by providing the core with a multilayer construction, solid golf balls can be conferred with both a soft feel and a good click by incorporating particles of a specific hardness within the solid core.

A first aspect of the invention thus provides a solid golf ball comprising a solid core and a cover enclosing the core, wherein the core is composed of, in admixture, a solid core-forming material and at least one particle made of a different material, which particle has a Shore D hardness at least 10 units higher than the surface hardness of the core. Preferably, the solid core is made of a rubber composition composed primarily of cis-1,4-polybutadiene and the particle is composed primarily of a thermoplastic resin or a thermoplastic elastomer. The particle typically has a diameter of 1 to 15 mm and a Shore D hardness of 60 to 95. Preferably at least 3 particles are incorporated within the solid core.

Moreover, through investigations aimed at improving the dull click of softer-type solid golf balls and also assuming good symmetry, we have found that by incorporating at least one particle of a different material within the solid core of the ball, restricting the difference in specific gravity between the particle and the core to within a range of ±0.1 and making the particle harder than the surface of the core, the particle improves both the feel and click of the ball upon impact without compromising the ball's resilience or softness of feel, and also confers the ball with good durability and symmetry.

Hence, a second aspect of the invention provides a solid golf ball comprising a solid core and a cover enclosing the core, wherein the core is composed of, in admixture, a solid core-forming material and at least one particle made of a different material, which particle has a specific gravity difference with the core of at most ±0.1 and is harder than the surface of the core. Preferably, the solid core is made of a rubber composition composed primarily of cis-1,4-polybutadiene and the particle is composed primarily of a thermoplastic resin or a thermoplastic elastomer. The particle typically has a diameter of 1 to 10 mm.

A further discovery we have made is that if, in order to improve the dull click of a softer-type solid golf ball, at least one particle made of a different material from the core is incorporated within the core in such a way that the particle accounts for 0.1 to 15% of the core volume and is not exposed on the surface of the core, the inclusion of the particle does not induce cracking of the solid core, the influence of the particle's resilience and hardness upon the ball as a whole is suppressed, and both a good feel and click are achieved. Moreover, the golf ball has an excellent durability.

Accordingly, a third aspect of the invention provides a solid golf ball comprising a solid core and a cover enclosing the core, wherein the core is composed of, in admixture, a solid core-forming material and at least one particle made of a different material, which particle accounts for 0.1 to 15% by volume of the core and is not exposed on the surface of the core. Preferably, the solid core is made of a rubber composition composed primarily of cis-1,4-polybutadiene and the particle is composed primarily of a thermoplastic resin or a thermoplastic elastomer. The particle typically has a diameter of 1 to 13 mm and is located at least 1 mm inside the surface of the core

BRIEF DESCRIPTION OF THE DRAWING

The only figure.

DETAILED DESCRIPTION OF THE INVENTION

Figure 1:
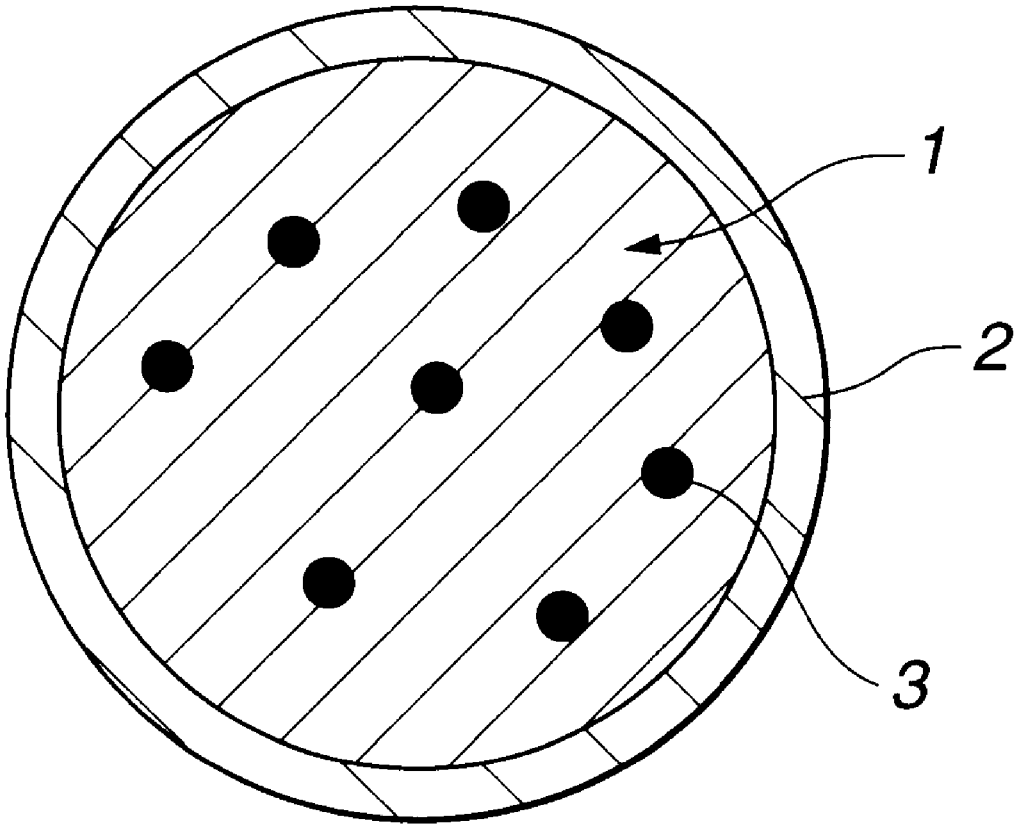
FIG. 1 is a sectional view showing a solid golf ball according to one embodiment of the invention.

Referring to FIG. 1, the solid golf ball of the invention has a solid core 1 enclosed within a cover 2. The solid core 1 includes one or more particles 3 therein. In the figure, several particles 3 are discretely distributed within the solid core 1.

The particle 3 of the invention is incorporated within the solid core 1 and serves in particular to improve the click of the ball.

The incorporated particle is made of a material that differs from the subsequently described solid core material, and preferably one that can be adjusted to a predetermined specific gravity and hardness. A thermoplastic resin or thermoplastic elastomer is especially advantageous as the particle material. Specific examples of suitable materials include polyamide resins, ionomer resins, thermoplastic polyurethane elastomers and thermoplastic polyester elastomers. Commercial products that are highly suitable for this purpose include Surlyn (an ionomer resin manufactured by E. I. du Pont de Nemours and Company), Himilan (an ionomer resin manufactured by DuPont-Mitsui Polychemicals Co., Ltd.) and Amilan CM (a polyamide resin manufactured by Toray Industries, Inc.). The particle used herein may be, for example, a small spherical particle that is available commercially or a pellet-like particle which can be procured directly from the manufacturer. Alternatively, the particle may be composed of, for example, the rubber compositions mentioned subsequently as the core material, in which case the proportions and composition of the ingredients therein may be adjusted as appropriate from those of the material actually employed to form the core.

The shape of the particles in the invention is not subject to any particular limitation, although a substantially spherical shape is preferred. "Spherical shape," used herein, does not refer only to a true sphere. It may also refer to a solid whose surface, in this case the particle surface, is composed of non-angular curved surfaces, so long as the particle can be visually recognized as spherical. However, particles having a relatively high degree of true sphericity are preferred.

The solid core which contains the particles is preferably made of a rubber composition comprising polybutadiene as the base. However, it may also be made of a relatively soft material selected from among thermoplastic resins and thermoplastic elastomers, such as thermoplastic polyester elastomers, polyamide resins, ionomer resins and thermoplastic polyurethane elastomers. It is also possible to use a rubber composition in admixture with a thermoplastic resin or a thermoplastic elastomer. Production of the solid core from a resin material may be carried out by first incorporating the particle within the resin material, then shaping the material by a suitable process such as injection molding.

The rubber composition comprising polybutadiene as the base is preferably one in which cis-1,4-polybutadiene, and especially cis-1,4-polybutadiene having a cis structure of at least 40%, serves as the base rubber. Where desired, other suitable rubber ingredients such as natural rubber, polyisoprene rubber or styrene-butadiene rubber may be compounded with the polybutadiene to give the base rubber.

A crosslinking agent may be included in the rubber composition. Exemplary crosslinking agents are the zinc and magnesium salts of unsaturated fatty acids, such as zinc dimethacrylate and zinc diacrylate, and ester compounds such as trimethylpropane methacrylate. Zinc diacrylate is especially preferred for achieving a high resilience. The crosslinking agent is preferably included in an amount of about 10 to about 30 parts by weight per 100 parts by weight of the base rubber.

A vulcanizing agent is generally compounded in the rubber composition. It is recommended that the vulcanizing agent include a peroxide having a one minute half-life temperature of not more than 155° C. Examples of suitable peroxides include commercially available products such as Perhexa 3M (dicumyl peroxide, manufactured by Nippon Oils and Fats Co., Ltd.). The amount of vulcanizing agent included in the rubber composition is preferably from about 0.6 to about 2 parts by weight per 100 parts by weight of the base rubber.

If necessary, other suitable ingredients may also be incorporated in the rubber composition, such as antioxidants and inorganic fillers (e.g., zinc oxide, barium sulfate) for modifying the specific gravity. The amount of inorganic filler included in the composition is typically up to about 40 parts by weight, preferably up to about 38 parts by weight, and more preferably up to about 30 parts by weight. A lower limit of at least about 5 parts by weight is preferable for better workability such as in the blending step. Too much filler may lower the workability during blending.

Production of the solid core from the rubber composition may be carried out by a known method, such as one that involves vulcanization and molding. Incorporation of the particles in the solid core can be effected by using, for example, a method in which the desired number of particles are randomly incorporated into the composition at the time of core slug formation, after which vulcanization and molding are carried out. This also serves to randomly disperse the particles in the solid core.

The solid core may be formed to the same diameter as prior-art solid cores. It is recommended that the core has a diameter of at least 34.0 mm, especially at least 34.5 mm and up to 41.0 mm, especially up to 40.0 mm. Too small a core diameter may make it difficult to achieve the desired ball resiliency, whereas too large a core diameter has a tendency to reduce ball performance such as cut resistance and durability.

The golf ball of the invention is made by enclosing the solid core with a cover. A known cover stock material may be used, suitable examples of which include ionomer resins, balata rubber, and thermoplastic polyurethane, polyamide and polyester elastomers. Formation of the cover is preferably carried out using a conventional process such as injection molding.

The thickness of the cover is not subject to any particular limitation. It is recommended that the cover has a thickness or gage of at least 1.0 mm, preferably at least 1.4 mm and more preferably at least 1.6 mm and up to 3.0 mm, preferably up to 2.5 mm, and more preferably up to 2.3 mm. A cover which is too thin may reduce the durability of the ball, whereas excessive thickness may compromise the feel.

First Embodiment

The solid golf ball according to the first embodiment of the invention has a construction in which the solid core containing the foregoing particle is enclosed within the cover. The particle has a Shore D hardness at least 10 units higher, and preferably at least 13 units higher, than the surface hardness of the core. It is recommended that the difference in Shore D hardness between the particle and the core surface be up to 70 units, preferably up to 65 units, and most preferably up to 60 units. Too small a difference in the Shore D hardness fails to provide the ball with an improved click.

The Shore D hardness of the particle itself may be adjusted as appropriate depending on the surface hardness of the solid core, and is not subject to any particular limitation. It is advantageous for the particle to have a Shore D hardness of at least 60, more preferably at least 62, most preferably at least 65 and up to 95, more preferably up to 90, most preferably up to 85. A Shore D hardness which is too low may fail to provide sufficient improvement in the click, whereas too high a hardness may give an excessive hardness difference with the core surface, resulting in a less durable core. The Shore D hardness of the particle, both in this embodiment and the other embodiments of the invention described below, is measured in accordance with ASTM D-2240.

In this embodiment, it is recommended that the particles have a diameter of at least 1 mm, more preferably at least 1.5 mm, most preferably at least 1.8 mm and up to 15 mm, more preferably up to 13 mm, and most preferably up to 12 mm.

Too small a particle diameter would fail to provide a good click and feel. On the other hand, a particle diameter which is too large would make it difficult to randomly incorporate the particles within the core. This can have the undesirable effect of giving the ball a center of gravity that differs from the spherical center of the ball, which can in turn cause inconsistent flight performance. No particular limit is imposed on the number of particles present in the core, although it is recommended that this number be at least 1, more preferably at least 2, most preferably at least 3 and at most 20, more preferably at most 18, most preferably at most 15. Improvement in the click of the ball cannot be achieved without the presence of particles in the core. However, too many particles in the core may give the ball too hard a feel upon impact. When more than one particle is included in the core, the particles may have the same or differing diameters.

In this embodiment, the "surface hardness" of the solid core refers to the value obtained by measuring the hardness at the surface of the manufactured solid core. As noted above, this hardness is at least 10 Shore D units lower than the hardness of the particle. The Shore D hardness at the surface of the solid core is itself typically at least 30, preferably at least 35 and most preferably at least 40. The upper limit in the Shore D hardness at the core surface is typically 65, preferably 60, more preferably 58, even more preferably 57 and most preferably 55. If the Shore D hardness at the surface of the solid core is higher than the hardness of the particle, an improvement in the dull click of the ball cannot be achieved.

In the first embodiment, the cover preferably has a Shore D hardness of at least 40, more preferably at least 42, most preferably at least 43 and up to 70, more preferably up to 68, most preferably up to 65. Too low a Shore D hardness may deprive the ball of sufficient resilience, whereas too high a Shore D hardness may compromise the feel and durability of the ball. The cover may have a multilayer construction, in which case the thickness and hardness of each layer should be adjusted so that the values for the cover as a whole fall within the above-indicated ranges. The Shore D hardness of the cover, both in this embodiment and the other embodiments of the invention described below, is measured in accordance with ASTM D-2240.

Second Embodiment

In the second embodiment of the solid golf ball according to the invention, the particle and the solid core have a specific gravity difference that is minimal. That is, the specific gravity of the particle differs from the specific gravity of the solid core matrix by not more than ±0.1 (i.e., within a range of −0.1 to +0.1), and preferably not more than ±0.09. A specific gravity difference outside of this range compromises the symmetry of the ball so that the desired symmetry cannot be attained. "Specific gravity difference," as used herein, refers both to cases where the solid core has the larger specific gravity and cases where the particle has the larger specific gravity. This difference is not subject to any particular limitation so long as it falls within the above-indicated range.

Not particular limitation is imposed on the specific gravity of the particle itself, provided the difference in specific gravity with the core falls within the above range. The particle preferably has a specific gravity of at least 1.00, more preferably at least 1.03, most preferably at least 1.05 and up to 1.25, more preferably up to 1.22, most preferably up to 1.20.

In this embodiment, the particle preferably has a diameter of at least 1 mm, more preferably at least 3 mm, most preferably at least 4 mm and up to 10 mm, more preferably up to 9 mm, most preferably up to 8 mm. A particle diameter which is too small may make it difficult to obtain a good click, and thus to achieve a sufficient improvement in the sound of the ball when hit. On the other hand, if the particle size is too large, the material of which the particle is made may have an excessive and undesirable influence on the qualities of the ball as a whole. For example, if the particle is made of a low resilient material, this may unduly lower the resilience of the overall ball. In particular, when the particle is made of a very hard material, the ball acquires a harder feel and may even be prone to cracking of the solid core matrix, as will be discussed subsequently. This latter effect can markedly reduce the durability of the ball.

The particle in this embodiment has a hardness which is higher than the surface hardness of the solid core discussed below. This feature gives the golf ball a better, higher pitched click upon impact that has been unattainable in conventional balls having multilayer cores. It is recommended that the Shore D hardness difference between the solid core surface and the particle be at least 2 units, preferably at least 3 units, more preferably at least 5 units and most preferably at least 10 units, but not more than 70 units, preferably not more than 65 units and most preferably not more than 60 units. Too small a Shore D hardness difference with the core surface may fail to produce a discernible improvement in the click.

The Shore D hardness of the particle itself is preferably at least 40, more preferably at least 45, most preferably at least 48 and up to 100, more preferably up to 95, most preferably up to 90.

In this embodiment, it is recommended that the number of particles in the solid core be at least 1, more preferably at least 2, most preferably at least 3 and at most 20, more preferably at most 18, most preferably at most 15. Improvement in the click of the ball cannot be achieved without the inclusion of particles in the core. However, if too many particles are present in the core, the characteristics of the particles may exert too great an influence on the characteristics of the ball as a whole. When more than one particle is included in the same solid core, the particle diameter and material may be the same or different for each particle without particular limitation.

The specific gravity of the matrix material in the solid core is adjusted according to the specific gravity of the particle such that, as noted above, the difference in their specific gravities falls within ±0.1, and preferably within ±0.09.

As already noted, the surface hardness of the solid core, which is the Shore D value obtained by measuring the hardness at the surface of the manufactured solid core, must be lower than the hardness of the particles present at the interior of the core. The preferred Shore D hardness difference with the particle has already been described above, but it is recommended that the Shore D hardness of the core surface itself be at least 30, more preferably at least 33, most preferably at least 35 and up to 70, more preferably up to 65, most preferably up to 50. If the Shore D hardness at the surface of the solid core is the same as or greater than the hardness of the particle, the golf ball cannot achieve both a soft feel and a good click upon impact.

The cover of the ball in this embodiment preferably has a Shore D hardness of at least 45, especially at least 50 and up to 70, especially up to 68. Too low a Shore D hardness may deprive the ball of sufficient resilience, whereas excessive hardness may compromise the feel and durability of the ball. The cover is not limited to only one layer, and may have a multilayer construction, in which case the thickness and hardness of each layer should be adjusted such that the values for the cover as a whole fall within the above-indicated ranges.

Third Embodiment

In a third embodiment of the present invention, the particle is incorporated within the solid core in a specific volumetric ratio. That is, the particle accounts for up to 15%, preferably up to 14%, more preferably up to 13% by volume and at least 0.1%, preferably at least 0.13%, more preferably at least 0.15% by volume, based on the volume of the solid core. The presence of one or more particles within the solid core in this volumetric ratio imparts the golf ball of this embodiment with both a good click and feel when hit. An overly high volumetric ratio of particles in the solid core creates problems such as interfacial separation at the boundary between the solid core matrix and the particle, compromising the durability of the ball. Moreover, when the volumetric ratio is too high, the low resilience and the hardness of the particle adversely affect the resilience and feel of the ball as a whole.

It is recommended that each particle in this embodiment have a diameter of at least 1 mm, more preferably at least 1.5 mm, most preferably at least 1.8 mm and up to 13 mm, more preferably up to 12 mm, most preferably up to 11.5 mm. Too small a diameter makes it difficult to achieve both a good click and feel. On the other hand, a particle diameter which is too large makes it impossible to incorporate the particle or particles within the core in a uniformly dispersed state. This can have the undesirable effect of giving the ball a center of gravity that differs from the spherical center of the ball, which can in turn cause inconsistent flight performance.

Typically, the number of particles incorporated within the same solid core is at least 1, more preferably at least 2, most preferably at least 4 and at most 30, more preferably at most 28, most preferably at most 26. The number of particles may be suitably adjusted in accordance with the particle diameter so as to achieve the volumetric ratio described above. For example, if the particles have a large diameter, it is advantageous to adjust the volumetric ratio of particles in the core by incorporating fewer particles in the core than when smaller diameter particles are used. Improvement in the click of the ball cannot be obtained without the inclusion of particles in the core. However, if too many particles are present in the core, the characteristics of the particles may exert too great an influence on the characteristics of the ball as a whole.

In this embodiment, the hardness of the particle is subject to any particular limitation, although it is preferred that the particle have a greater hardness than the surface of the solid core. The particle typically has a Shore D hardness that is higher than the Shore D hardness at the core surface by at least 2 units, more preferably at least 3 units, most preferably at least 5 units and up to 70 units, more preferably up to 65 units, most preferably up to 60 units. Too small a difference with the Shore D hardness at the core surface may fail to provide a discernible improvement in the click, whereas too large a hardness difference may have an undesirable effect on the feel.

The Shore D hardness of the particle itself is typically at least 40, more preferably at least 45, most preferably at least 48 and up to 100, more preferably up to 95, most preferably up to 90.

In this embodiment, it is critical that incorporation of the particle or particles in the solid core be carried out in such a way that the particles are not exposed on the surface of the core. To improve the click and feel of the ball and enhance the ball's durability, it is recommended that each particle be located at least 1 mm, more preferably at least 1.2 mm, most preferably at least 1.4 mm and up to 20 mm, more preferably up to 18 mm, most preferably up to 17 mm, inside the core surface. Any of various suitable methods may be employed to make a solid core containing a particle or particles within this range. In one such method, first there is produced a smaller than full-sized core comprising a slug of the rubber composition described above in which the particles have been dispersed. Next, a pair of half-cups made of rubber which does not contain any of the particles and has been semi-vulcanized in a mold are placed over the smaller core, following which secondary vulcanization is carried out. Alternatively, a pair of half-cups may be injection-molded from a suitable resin material mentioned above, then placed around a solid inner core already loaded with particles, and compression-molded.

Preferably, the specific gravity of the core matrix thus obtained is adjusted so that the difference in specific gravity with the particle or particles may fall within ±0.1.

In this embodiment, the surface hardness of the solid core is the value obtained by measuring the Shore D hardness at the surface of the solid core thus produced. It is advantageous for this value to be lower than the Shore D hardness of the particles incorporated at the interior of the core. The preferred difference in Shore D hardness with the particles has already been described above. It is recommended that the Shore D hardness at the core surface be at least 30, more preferably at least 35, most preferably at least 40 and up to 58, more preferably up to 57, most preferably up to 55. A Shore D hardness at the surface of the solid core which is higher than the particle hardness may make it impossible to achieve any improvement in the dull click of the ball on impact.

The solid core in this embodiment may be comprised of a single layer or two or more concentric layers composed of like or unlike materials. In either case, it is preferable for the constituent layer or layers to be formulated such that the specific gravity difference and surface hardness for the solid core as a whole fall within the above-described ranges. It should be noted also that the volumetric ratio of the particle or particles incorporated in the core is based on the volume of the entire core.

In this embodiment, the cover of the ball preferably has a Shore D hardness of at least 45, especially at least 50 and up to 70, especially up to 68. Too low a Shore D hardness may deprive the ball of sufficient resilience, whereas excessive hardness may compromise the feel and durability of the ball. The cover is not limited to only one layer, and may have a multilayer construction, in which case the thickness and hardness of each layer should be set such that the values for the cover as a whole fall within the above-indicated ranges.

Most preferably, the solid golf ball according to the present invention combines the features of all three of the embodiments described above.

As in conventional golf balls, the golf ball of the invention has numerous dimples formed on the surface of the cover. The total number of dimples is typically from 350 to 500, preferably from 370 to 480, and most preferably from 390 to 450. The dimples may have a geometrical arrangement that is octahedral or icosahedral, for example. Nor is the dimple pattern limited to a circular pattern, the use of any other suitable pattern, such as a square, hexagonal, pentagonal or triangular pattern, also being acceptable.

The inventive golf ball may be formed so as to have a diameter and weight which conform with the Rules of Golf. That is, the ball may have a diameter of from 42.67 mm to 42.75 mm, and a weight of from 45.1 g to 45.93 g, and preferably from 45.2 g to 45.8 g.

EXAMPLE

Examples of the invention and comparative examples are given below by way of illustration, and are not intended to limit the invention.

Examples 1 to 4, and Comparative Examples 1 to 3

The particles used in Examples 1 and 2 were produced by blending in a kneader the particle formulations shown in Table 1, then extruding the mixture as a rod, and chopping the extrudate into cylindrical resin pellets of 2.0 mm diameter and about 2.0 mm length. The particles used in Examples 3 and 4 and Comparative Examples 1 and 2 were produced by injection molding the formulations shown in Table 1.

In each example, the rubber composition constituted as shown in Table 1 was rolled into a sheet, particles were dispersed randomly on the sheet, and the desired slug was formed and vulcanized. Vulcanization was carried out at 155° C. for 25 minutes, yielding a solid core containing randomly dispersed particles.

Click and Feel

The click and feel of the golf balls in each example when hit with identical drivers were rated as follows by three golfers. Results shown in Table 1 are the averaged ratings for each ball.

Feel

Exc: Excellent feel

Good: Good feel

Fair: Normal (not particularly good feel)

Poor: No improvement in feel whatsoever

Click

Good: Good click

Fair: Normal (not particularly good click)

Poor: No improvement in click whatsoever

TABLE 1

| | | | | EX1 | EX 2 | EX 3 | Ex 4 | CE 1 | CE 2 | CE 3 |
|---|---|---|---|---|---|---|---|---|---|---|
| Solid core | Particle | Formulation (pbw) | Amilan CM1007 (polyamide) | | | 100 | 100 | | | |
| | | | Hytrel 4701 (polyester) | | | | | 100 | | |
| | | | Himilan 1605 (ionomer) | 50 | 50 | | | | 50 | |
| | | | Himilan 1706 (ionomer) | 50 | 50 | | | | 50 | |
| | | Shape/ properties | Diameter (mm) | 2 | 2 | 3 | 4 | 5 | 30 | |
| | | | Number of particles in core | 10 | 6 | 6 | 4 | 3 | 1 | |
| | | | Shore D hardness | 62 | 62 | 86 | 86 | 47 | 62 | |
| | Solid core (matrix) | Formulation (pbw) | cis-1,4-Polybutadiene | 100 | 100 | 100 | 100 | 100 | 100 | 100 |
| | | | Zinc oxide | 5 | 5 | 5 | 5 | 5 | 5 | 5 |
| | | | Antioxidant | 0.2 | 0.2 | 0.2 | 0.2 | 0.2 | 0.2 | 0.2 |
| | | | Zinc diacrylate | 20.0 | 14.0 | 26.0 | 23.0 | 19.5 | 34.0 | 26.0 |
| | | | Barium sulfate | 25.5 | 28.0 | 22.5 | 24.0 | 25.8 | 56.0 | 22.5 |
| | | | Dicumyl peroxide | 1.2 | 1.2 | 1.2 | 1.2 | 1.2 | 1.2 | 1.2 |
| | Shape and properties | | Diameter (mm) | 38.5 | 38.5 | 38.5 | 38.5 | 38.5 | 38.5 | 38.5 |
| | | | Weight (g) | 34.9 | 34.9 | 34.9 | 34.8 | 35.0 | 35.0 | 35.0 |
| | | | Core surface hardness (Shore D) | 47 | 43 | 52 | 50 | 47 | 58 | 52 |
| | | | Shore D hardness difference with particle | 15 | 19 | 34 | 36 | 0 | 4 | — |
| Cover | Cover stock | Formulation (pbw) | Himilan 1605 (ionomer) | 50 | 50 | | 50 | | 50 | 50 |
| | | | Himilan 1706 (ionomer) | 50 | 50 | | 50 | | 50 | 50 |
| | | | Himilan 1557 (ionomer) | | | 50 | | 50 | | |
| | | | Himilan 1601 (ionomer) | | | 50 | | 50 | | |
| | Shape and properties | | Shore D hardness | 62 | 62 | 58 | 62 | 58 | 62 | 62 |
| | | | Thickness (mm) | 2.1 | 2.1 | 2.1 | 2.1 | 2.1 | 2.1 | 2.1 |
| Overall ball | Shape and prpoerties | | Weight (g) | 45.2 | 45.2 | 45.2 | 45.1 | 45.3 | 45.3 | 45.3 |
| | | | Diameter (mm) | 42.7 | 42.7 | 42.7 | 42.7 | 42.7 | 42.7 | 42.7 |
| | | | Feel | Good | Good | Exc | Exc | Good | Poor | Good |
| | | | Click | Good | Good | Good | Good | Poor | Poor | Fair |

The solid core was then placed in a mold and a cover having the characteristics shown Table 1 was formed over it, thereby producing golf balls bearing dimples of identical shape and arrangement on the surface.

The properties of the resulting golf balls were evaluated as described below. The results are shown in Table 1. The core surface hardness was determined by measuring the hardness at the surface of the core produced by the method described above. The particle hardness and cover hardness were measured in accordance with ASTM D-2240.

As is apparent from Table 1, the golf balls according to the invention all had both a good click and a good feel.

By contrast, the golf ball in Comparative Example 1 lacked a difference in hardness between the particles and the solid core, as a result of which an improved click was not achieved.

In Comparative Example 2 the particle and the solid core of the golf ball differed in hardness, but the difference in hardness was smaller than is called for in the invention. Both the click and feel were worse than for the golf ball of Comparative Example 1 which contained particles of the same hardness as the core.

The golf ball of Comparative Example 3 did not contain any particles and likewise showed no improvement in either click or feel.

Examples 5 to 8, and Comparative Examples 4 to 6

Particles were produced by blending the particle compositions shown in Table 2, then injection molding spherical particles of the respective diameters and specific gravities shown in Table 2.

The respective rubber compositions shown in Table 2 were prepared as the core base and rolled into a sheet. Particles were dispersed on the sheet, which was then formed into a slug of the desired size. The slug was vulcanized at 155° C. for 25 minutes, yielding a solid core containing randomly dispersed spherical particles.

The solid core was then placed in a mold and the cover stock shown in Table 2 was injected around it, thus producing golf balls bearing dimples of identical shape and arrangement on the surface.

The properties of the resulting golf balls were evaluated as described below. The results are shown in Table 2. The core surface hardness was determined by measuring the hardness at the surface of the core produced by the method described above. The particle hardness and cover hardness were measured in accordance with ASTM D-2240.

Click and Feel

The click and feel of the golf balls in each example were rated as follows by three golfers having club head speeds of about 45 m/s. Results shown in Table 2 are the averaged ratings for each ball.

Feel

Good: Appropriately soft, yet solid feel

Fair: Ordinary (not particularly good feel)

Poor: Too hard

Click

Good: Good click

Poor: Dull sound

Durability

Each ball was hit 50 times with a driver mounted on a swing robot, following which the surface state of the ball was evaluated according to the following criteria. Results were averaged for each ball.

Good: No cuts or cracks on surface

Fair: Normal (same degree of durability as conventional balls)

Poor: Ball cracked (interfacial cracking between solid core and particle, core cracking)

Symmetry

Twenty-four balls for each example and comparative example were furnished for testing. In accordance with the Rules of Golf, the balls were pole hit and seam hit, and the distance and flight time for each shot measured, based on which the symmetry was rated as follows.

Good: Good symmetry (distance and flight time were consistent)

Poor: Poor symmetry (distance and flight time were inconsistent)

TABLE 2

| | | | EX 5 | EX 6 | EX 7 | EX 8 | CE 4 | CE 5 | CE 6 |
|---|---|---|---|---|---|---|---|---|---|
| Solid core | Particle formulation (pbw) | Himilan 1557 (ionomer) | | | | | 50 | | |
| | | Himilan 1601 (ionomer) | | | | | 50 | | |
| | | Himilan 1605 (ionomer) | 50 | 50 | | 50 | | | |
| | | Himilan 1706 (ionomer) | 50 | 50 | | 50 | | | |
| | | Amilan CM1007 (polyamide) | | | 100 | | | | |
| | | Hytrel 4001 (polyester) | | | | | | 100 | |
| | | Barium sulfate | 17.8 | 35.8 | | 20.3 | 53.9 | 10.9 | |
| | Shape/ properties | Diameter (m) | 4 | 5 | 7 | 8 | 13 | 10 | |
| | | Number of particles in core | 8 | 6 | 4 | 3 | 3 | 2 | |
| | | Specific gravity | 1.10 | 1.22 | 1.14 | 1.12 | 1.33 | 1.21 | |
| | | Shore D hardness | 63 | 63 | 86 | 63 | 64 | 40 | |
| | Solid core (matrix) formulation (pbw) | cis-1,4-Polybutadiene | 100 | 100 | 100 | 100 | 100 | 100 | 100 |
| | | Zinc oxide | 5 | 5 | 5 | 5 | 5 | 5 | 5 |
| | | Barium sulfate | 17.2 | 10.0 | 10.7 | 5.7 | 14.7 | 21.0 | 26.0 |
| | | Zinc diacrylate | 24.0 | 24.0 | 21.5 | 21.5 | 27.6 | 21.5 | 22.5 |
| | | Dicumyl peroxide | 1.2 | 1.2 | 1.2 | 1.2 | 1.2 | 1.2 | 1.2 |
| | Shape/ properties | Diameter (mm) | 38.5 | 38.5 | 38.5 | 38.5 | 38.5 | 38.5 | 38.5 |
| | | Weight (g) | 35.0 | 33.8 | 32.9 | 32.3 | 35.0 | 35.0 | 35.0 |
| | | Specific gravity (solid core matrix) | 1.17 | 1.13 | 1.10 | 1.08 | 1.15 | 1.17 | 1.17 |
| | | Specific gravity difference with particles | −0.07 | 0.09 | 0.04 | 0.04 | 0.18 | 0.04 | — |
| | | Core surface hardness (Shore D) | 53 | 53 | 45 | 45 | 56 | 45 | 59 |
| | | Hardness difference with particles | 10 | 10 | 41 | 18 | 8 | −5 | — |
| Cover | Formulation (pbw) | Himilan 1605 (ionomer) | | | 50 | | | 50 | 50 |
| | | Himilan 1706 (ionomer) | | | 50 | | | 50 | 50 |
| | | Himilan 1557 (ionomer) | 50 | 50 | | 50 | 50 | | |
| | | Himilan 1601 (ionomer) | 50 | 50 | | 50 | 50 | | |
| | | Barium sulfate | | 14.9 | 27.8 | 36.9 | | | |
| | Shape/ properties | Specific gravity | 0.98 | 1.09 | 1.18 | 1.24 | 0.98 | 0.98 | 0.98 |
| | | Shore D hardness | 58 | 59 | 64 | 61 | 58 | 62 | 62 |
| | | Thickness (mm) | 2.1 | 2.1 | 2.1 | 2.1 | 2.1 | 2.1 | 2.1 |
| Overall ball | Shape/ properties | Weight (g) | 45.3 | 45.3 | 45.3 | 45.3 | 45.3 | 45.3 | 45.3 |
| | | Diameter (mm) | 42.7 | 42.7 | 42.7 | 42.7 | 42.7 | 42.7 | 42.7 |

TABLE 2-continued

| | | EX 5 | EX 6 | EX 7 | EX 8 | CE 4 | CE 5 | CE 6 |
|---|---|---|---|---|---|---|---|---|
| HS = 45 m/s | Feel | good | good | good | good | poor | good | good |
| | Click | good | good | good | good | good | poor | poor |
| | Durability | good | good | good | good | poor | good | good |
| | Symmetry | good | good | good | good | poor | good | good |

As is apparent from the results in Table 2, the golf balls of the invention all had both a good click and feel. In addition, their durability and symmetry were excellent.

Examples 9 to 13, and Comparative Examples 7 to 9

Particles were produced by blending the particle compositions shown in Table 3, then injection molding spherical particles of the respective diameters and specific gravities shown in Table 3.

In each example, the inner core rubber compositions shown in Table 3 was prepared as the core base, and rolled into a sheet. Particles were dispersed on the sheet, which was then formed into a slug of the desired size. The slug was vulcanized at 155° C. for 25 minutes, yielding a center sphere containing randomly dispersed spherical particles.

In Examples 9 to 12, a pair of half-cups were formed from rubber compositions for use as the outer core, then placed over the center sphere and vulcanized, giving a solid core. In Example 13, Hytrel 3548W was injection molded over the center sphere to form the solid core.

The solid core was then placed in a mold and the cover stock shown in Table 3 was injected around it to produce golf balls bearing dimples of identical shape and arrangement on the surface.

The feel, click and durability of the resulting golf balls were evaluated in the same manner as described above for Examples 5 to 8. The results are shown in Table 3. The hardness of the particles and the hardness of the cover were measured in accordance with ASTM D-2240.

TABLE 3

| | | | EX 9 | EX 10 | EX 11 | EX 12 | EX 13 | CE 7 | CE 8 | CE 9 |
|---|---|---|---|---|---|---|---|---|---|---|
| Particles | Formulation (pbw) | Amilan CM1007 (polyamide) | | | | 100 | 100 | 100 | | |
| | | Hytrel 4767 (polyester) | | | | | | | | 100 |
| | | Himilan 1557 (ionomer) | 50 | 50 | 50 | | | | | |
| | | Himilan 1605 (ionomer) | 50 | 50 | 50 | | | | | |
| | | Tungsten | 25.5 | 25.5 | 25.5 | | | | | |
| | Parameters | Specific gravity | 1.17 | 1.17 | 1.17 | 1.13 | 1.13 | 1.13 | | 1.15 |
| | | Diameter (mm) | 3 | 3 | 6 | 5 | 6 | 14 | | 14 |
| | | Number of particles in core | 6 | 12 | 4 | 6 | 6 | 4 | | 4 |
| | | Shore D hardness | 63 | 63 | 63 | 86 | 86 | 86 | | 47 |
| Solid core | Inner core formulation (pbw) | cis-1,4-Polybutadiene | 100 | 100 | 100 | 100 | 100 | 100 | 100 | 100 |
| | | Zinc oxide | 5 | 5 | 5 | 5 | 5 | 5 | 5 | 5 |
| | | Barium sulfate | 26.5 | 26.5 | 29.0 | 19.0 | 28.0 | 19.0 | 21.0 | 28.0 |
| | | Zinc diacrylate | 16.5 | 16.5 | 10.0 | 34.0 | 30.0 | 34.0 | 30.0 | 30.0 |
| | | Dicumyl peroxide | 1.2 | 1.2 | 1.2 | 1.2 | 1.2 | 1.2 | 1.2 | 1.2 |
| | Parameters | Diameter (mm) | 29.5 | 33.5 | 34.5 | 35.0 | 27.0 | | | 35.0 |
| | | Specific gravity | 1.17 | 1.17 | 1.17 | 1.17 | 1.21 | | | 1.17 |
| | | Shore D hardness | 45 | 45 | 40 | 58 | 55 | | | 58 |
| | Outer core formulation (pbw) | cis-1,4-Polybutadiene | 100 | 100 | 100 | 100 | | | | 100 |
| | | Zinc oxide | 5 | 5 | 5 | 5 | | | | 5 |
| | | Barium sulfate | 26.5 | 26.5 | 29.0 | 21.0 | | | | 28.0 |
| | | Zinc diacrylate | 16.5 | 16.5 | 10.0 | 29.0 | | | | 30.0 |
| | | Dicumyl peroxide | 1.2 | 1.2 | 1.2 | 1.2 | | | | 1.2 |
| | | Hytrel 3548W | | | | | 100 | | | |
| | Parameters | Specific gravity | 1.17 | 1.17 | 1.17 | 1.17 | 1.15 | 1.17 | 1.17 | 1.17 |
| | | Diameter (mm) | 38.5 | 38.5 | 38.5 | 38.5 | 38.5 | 38.5 | 38.5 | 38.5 |
| | | Thickness (mm) | 4.5 | 2.5 | 2.0 | 1.8 | 5.8 | — | — | 1.8 |
| | | Weight (g) | 35.0 | 35.0 | 35.0 | 35.0 | 35.0 | 35.0 | 35.0 | 35.0 |
| | | Surface Shore D hardness | 45 | 55 | 55 | 55 | 35 | 58 | 55 | 55 |
| | Volumetric ratio of particles (%) | | 0.28 | 0.57 | 1.51 | 1.31 | 2.27 | 19.23 | 0.00 | 19.23 |
| Cover | Formulation | Himilan 1605 (ionomer) | 50 | 50 | | | 50 | | 50 | |
| | | Himilan 1706 (ionomer) | 50 | 50 | | | 50 | | 50 | |
| | | Himilan 1557 | | | 50 | 50 | | 50 | | 50 |

TABLE 3-continued

| | | | EX 9 | EX 10 | EX 11 | EX 12 | EX 13 | CE 7 | CE 8 | CE 9 |
|---|---|---|---|---|---|---|---|---|---|---|
| | | (ionomer) | | | | | | | | |
| | | Himilan 1601 (ionomer) | | | 50 | 50 | | 50 | | 50 |
| | Parameter | Thickness (mm) | 2.1 | 2.1 | 2.1 | 2.1 | 2.1 | 2.1 | 2.1 | 2.1 |
| Overall ball | Parameters | Weight (g) | 45.3 | 45.3 | 45.3 | 45.3 | 45.3 | 45.3 | 45.3 | 45.3 |
| | | Diameter (mm) | 42.7 | 42.7 | 42.7 | 42.7 | 42.7 | 42.7 | 42.7 | 42.7 |
| | HS = 45 m/s | Feel | good | good | good | good | good | poor | good | fair |
| | | Click | good | good | good | good | good | good | poor | poor |
| | | Durability | good | good | good | good | good | poor | good | fair |

As is apparent from the results in Table 3, the golf balls of the invention all had a good click, feel and durability.

Japanese Patent Application Nos. 11-173635, 11-173636 and 11-173637 are incorporated herein by reference.

Although some preferred embodiments have been described, many modifications and variations may be made thereto in light of the above teachings. It is therefore to be understood that the invention may be practiced otherwise than as specifically described without departing from the scope of the appended claims.

What is claimed is:

1. A solid golf ball comprising a solid core and a cover enclosing the core, wherein the core is composed of, in admixture, a solid core-forming material and at least one particle of a different material, said particle having a Shore D hardness of at least 10 units higher than the surface hardness of the core and having a diameter of about 1 to 15 mm.

2. The golf ball of claim 1, wherein the solid core is made of a rubber composition composed primarily of cis-1,4-polybutadiene.

3. The golf ball of claim 1, wherein the particle is composed primarily of a thermoplastic resin or a thermoplastic elastomer.

4. The golf ball of claim 1, wherein the particle has a Shore D hardness of 60 to 95.

5. The golf ball of claim 1, wherein the solid core contains at least 3 particles.

6. A solid golf ball comprising a solid core and a cover enclosing the core, wherein the core is composed of, in admixture, a solid core-forming material and at least one particle of a different material, said particle having a specific gravity that is different than a specific gravity of the core of at most ±0.1, said particle being harder than the surface of the core and having a diameter of about 1 to 10 mm.

7. The golf ball of claim 6, wherein the solid core is made of a rubber composition composed primarily of cis-1,4-polybutadiene.

8. The golf ball of claim 6, wherein the particle is composed primarily of a thermoplastic resin or a thermoplastic elastomer.

9. A solid golf ball comprising a solid core and a cover enclosing the core, wherein the core is composed of, in admixture, a solid core-forming material and at least one particle of a different material, said particle accounting for 0.1 to 15% by volume of the core and not being exposed on the surface of the core, being harder than the surface of the core, and having a diameter of about 1 to 13 mm.

10. The golf ball of claim 9, wherein the solid core is made of a rubber composition composed primarily of cis-1,4-polybutadiene.

11. The golf ball of claim 9, wherein the particle is composed primarily of a thermoplastic resin or a thermoplastic elastomer.

12. The golf ball of claim 9, wherein the particle is located at least 1 mm inside the surface of the core.

13. A solid golf ball comprising a solid core and a cover enclosing the core, wherein the core is composed of, in admixture, a solid core-forming material and at least one particle of a different material, wherein said particle accounts for 0.1 to 15% by volume of the core and is located at least 1 mm inside the surface of the core such that said particle is not exposed on the surface of the core.

14. The golf ball of claim 13, wherein said particle is composed primarily of a thermoplastic resin or a thermoplastic elastomer.

15. The golf ball of claim 13, wherein the solid core is made of a rubber composition composed primarily of cis-1,4-polybutadiene.

16. A solid golf ball comprising a solid core and a cover enclosing the core, wherein the core is made of a rubber composition composed primarily of cis-1,4-polybutadiene and includes one or more particles dispersed in the core, said particle being composed primarily of a thermoplastic resin or a thermoplastic elastomer.

17. The golf ball of claim 16, wherein said particle is harder than the surface of the core.

18. The golf ball of claim 16, wherein said particle has a Shore D hardness of at least 10 units higher than the surface hardness of the core.

19. The golf ball of claim 16, wherein said particle has a diameter of 1 to 10 mm.

20. The golf ball of claim 16, wherein said particle accounts for 0.1 to 15% by volume of the core.

* * * * *